US005901870A

United States Patent [19]

Wagner

[11] Patent Number: 5,901,870

[45] Date of Patent: May 11, 1999

[54] PILFERPROOF COVER AND A CONTAINER ASSOCIATED THEREWITH

[75] Inventor: Armand Wagner, Esch. Alzette, Luxembourg

[73] Assignee: Lynes Holdings S.A., Gr. D., Luxembourg

[21] Appl. No.: 08/891,054

[22] Filed: Jul. 10, 1997

[51] Int. Cl.[6] ..... B65D 41/48

[52] U.S. Cl. ..... 220/276; 215/256

[58] Field of Search ..... 215/256; 220/276

[56] References Cited

U.S. PATENT DOCUMENTS

| | | | |
|---|---|---|---|
| 3,979,003 | 9/1976 | Allen | 215/256 |
| 4,066,181 | 1/1978 | Robinson et al. | 215/256 |
| 4,438,857 | 3/1984 | Bullock, III | 215/256 |
| 4,625,876 | 12/1986 | Bullock, III | 220/276 X |
| 4,678,094 | 7/1987 | Bullock | 215/256 |
| 4,691,834 | 9/1987 | Bullock, III | 215/256 X |
| 4,790,448 | 12/1988 | Ostrum et al. | 220/276 X |
| 4,903,849 | 2/1990 | Wallman | 215/256 |
| 5,092,478 | 3/1992 | La Pierre | 220/276 X |
| 5,115,934 | 5/1992 | Nelson | 220/276 |
| 5,224,616 | 7/1993 | Crisci | 215/256 |

FOREIGN PATENT DOCUMENTS

| | | | |
|---|---|---|---|
| 954475 | 9/1974 | Canada | 215/256 |
| 2412469 | 8/1979 | France | 215/256 |
| 3623765 | 1/1987 | Germany | 215/256 |
| 955276 | 4/1964 | United Kingdom | 215/256 |
| 1509548 | 5/1978 | United Kingdom | 215/256 |

*Primary Examiner*—Stephen K. Cronin
*Assistant Examiner*—Nathan Newhouse
*Attorney, Agent, or Firm*—Thomas S. Baker, Jr.

[57] ABSTRACT

A pilferproof or tamper resistant cover or lid for a container comprising a skirt having on its inner surface a circumferential nose for engaging a flange at an upper end of the container and a tear-off safety band having an inwardly inclined generally half tear-shaped cross-sectional form adapted to be snugly received in a groove of the container below the flange thereof.

13 Claims, 3 Drawing Sheets

FIG. 3a
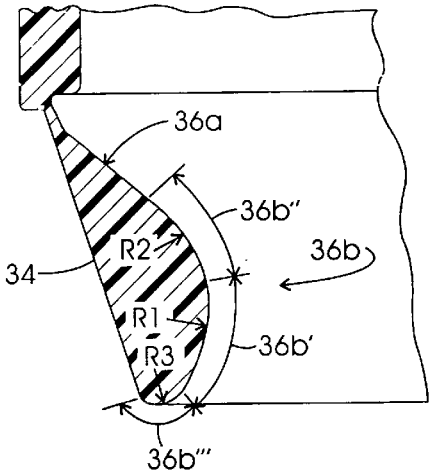
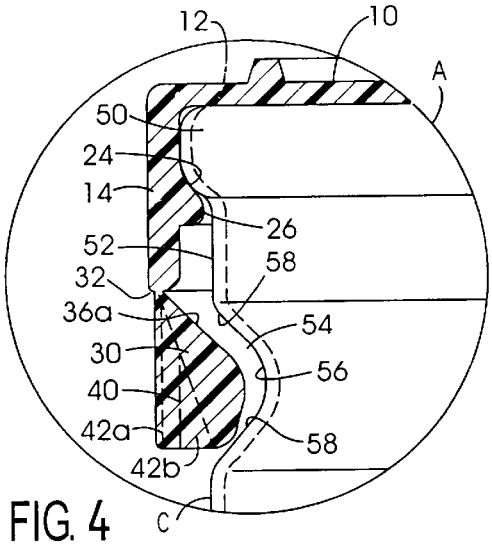
FIG. 4
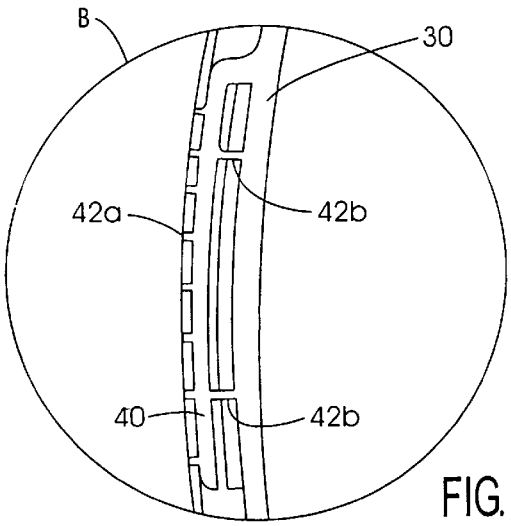
FIG. 6
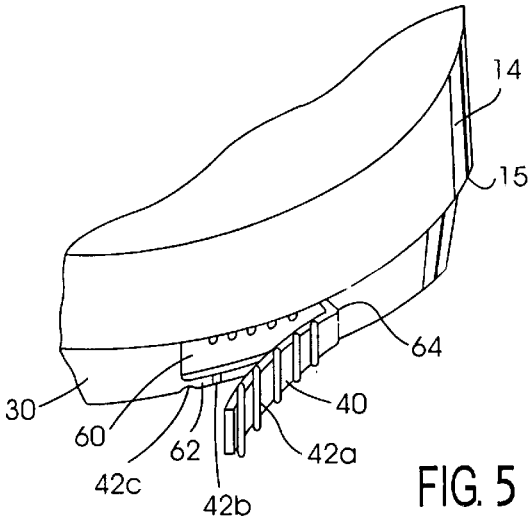
FIG. 5

PILFERPROOF COVER AND A CONTAINER ASSOCIATED THEREWITH

BACKGROUND OF THE INVENTION

Field of the Invention

The present invention relates to a pilferproof or tamper resistant cover or lid for a container, and also to a combination of the cover and container.

In the packaging art pilferproof screw-on caps have been developed for bottles or like containers. These caps provide an effective closure of the bottles and assure the consumer that the bottles have not been already opened. The known caps are generally made of a polymeric material and are characterized by a small dimension.

More recently, some attempts have been made to develop larger press-on covers or lids for cylindrical containers such as tins or the like. However, these known covers with the safety rings are difficult to apply to the containers without damaging the safety ring or there is an unsatisfactory adaptation between the container and the safety ring detracting from the pilferproof or tamper resistant engagement between the cover and the container. With the known covers, it is required to modify the machinery to apply the covers to the containers. This is due to the fact that the known covers cannot be applied or attached to the containers by a simple pressure applied to the covers on the top of the tins. Further, the known covers cannot be regularly stacked during the storage because of the presence of a safety ring maintaining tightly the cover in contact with the container device. Furthermore, the covers, when stored, where damaged and distorted because of the pressure developed by the covers one another. This problem of distortion is due to the fact that the covers are larger than the caps used for bottles or the like and that the covers can slide relative to one another during storage thereof Another problem encountered with the use of the above mentioned covers, resides in the fact that the safety ring comprises a tear-off tab which is grasped by the consumer to tear-off the safety ring when it is desired to open the container. This tear-off tab can interfere with the tabs of other safety rings due to the protruding position of the tear-off tab.

An object of the present invention is to provide a pilferproof or tamper resistant cover or lid which can be easily applied to a container while making it impossible to remove the lid or cover without tearing off the safety ring.

A further object of the present invention is to provide pilferproof or tamper resistant covers or lids that can be stacked on one another for packaging and prevent slip-off of the cover from one another and avoid damage or distortion of the covers.

A further object of the present invention is to provide a pilferproof or tamper resistant cover or lid having an improved safety ring to facilitate application of the cover to a container without modification of the existing assembly machinery.

Another object of the present invention is to provide a pilferproof or tamper resistant cover or lid in which the tear-off tab does not extend outwardly beyond the circumferential periphery of the cover.

Another objet of the present invention is to provide a container consistent with the cover or lid of the present invention.

SUMMARY OF THE INVENTION

The present invention provides a pilferproof cover for a container, having an axial centerline, comprising:

a circular end wall having an upper end surface and an outer periphery having an outer diameter;

a cylindrical skirt extending downwardly from the outer periphery of the end wall and having a lower end and a radially inner surface and an outer axial surface;

means for removably retaining the cover on a container, said means being provided on the radially inner surface of the skirt; and an annular tear-off safety ring extending downwardly and radially inwardly from the lower end of the skirt, said safety ring having an upper end and a lower end, the upper end of the safety ring being connected by means of a circumferentially extending rupturable connection to the lower end of the skirt, the safety ring having a generally convex inwardly bulged inner surface. The safety ring may have a generally half tear-shaped cross-sectional form with a generally flat outer surface tapering inwardly relative to the outer surface of the skirt and, with the maximum thickness of the safety ring being closer to its lower end than to its upper end. More specifically the flat outer surface may form a first acute angle with a line extending parallel to the axial centerline of the cover, said flat outer surface extending substantially from the upper end of the safety ring to the lower end thereof, and said inner surface may have an upper flat section extending from the upper end of the safety ring and a lower curved section extending from the section flat to the lower end of the safety ring, said upper flat section forming, with said parallel line, a second acute angle which is larger than the first acute angle.

In the preferred embodiment the safety ring has a tear-off tab which does not extend radially outwardly beyond the outer axial surface of the skirt.

Preferably, an annular rib having an outer diameter is provided on the upper end surface of the end wall and spaced radially inwardly from the outer periphery thereof and the lower end of the safety ring has a diameter larger than the outer diameter of the annular rib and smaller than the diameter of the outer periphery of the circular end wall so that the cover can be stacked on another like cover with the annular safety ring of the first cover engaging said other cover on the end wall between the outer periphery thereof and the annular rib so that the annular rib prevents slipping off of the covers from one another in transverse direction.

The curved inner, lower surface section may have a compound curvature to facilitate slipping on of the cover onto an end of the container.

The curved inner lower surface section of the safety ring may have a first intermediate curved surface portion having a first radius of curvature, a second curved surface portion between the intermediate curved surface portion and the flat inner upper surface section and having a second radius of curvature, and a third curved surface portion between the intermediate curved surface portion and the flat outer surface at the lower end of the safety ring and having a third radius of curvature, wherein the second radius of curvature is smaller than the first radius of curvature and the third radius of curvature is smaller than the second radius of curvature.

The cover is preferably formed of a polymer material, such as plastic, although any resilient material could be used.

The container on which the cover is to be mounted has at one end a circumferential projection and a circumferential groove spaced below the circumferential projection. With the cover mounted on the container a lower end portion of the safety ring is snugly nested within the circumferential groove with the diameter of the lower end of the safety ring being substantially equal to the outer diameter of the container and the lower end of the safety ring being closely adjacent to or contacting the outer container wall substantially at a location where a lower edge of the circumferential groove merges with the cylindrical outer wall of the container.

Preferably the groove is V-shaped and has a rounded bottom and two inclined side walls smoothly merging with the outer cylindrical wall of the container.

The container can be a tin, such as a metallic tin, or the like.

Other objects, advantages and features will become more apparent with the teaching of the principles of the invention in connection with the disclosure of the preferred embodiments in the specification, claims and drawings.

BRIEF DESCRIPTION OF THE DRAWINGS

FIG. 3*a* is a partial cross-sectional view of the lower end of the cover or lid showing the safety band or ring.

FIG. 4 is an enlarged view of the detail A in FIG. 1;

FIG. 5 is a fragmentary bottom view at an enlarged scale of the detail B of the tear-off lip portion of FIG. 2 of the safety band or ring; and FIG. 6 is a fragmentary perspective view of the cover or lid with the tear-off lip portion partially pivoted away from the safety band or ring to illustrate the construction of the safety band or ring in the area of the tear-off lip.

DESCRIPTION OF THE PREFERRED EMBODIMENT

Figure 1:
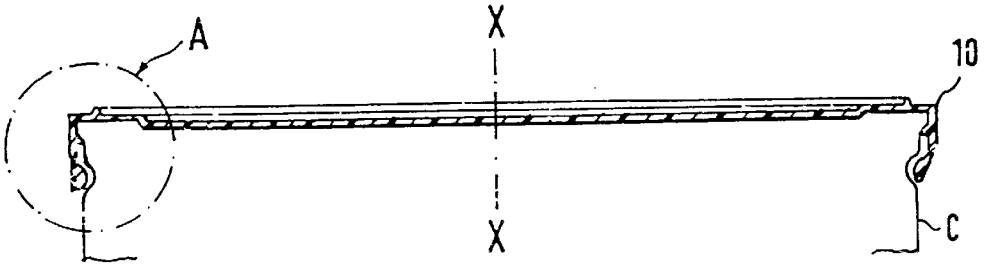
FIG. 1 is a cross-sectional view of the cover or lid of FIG. 1, applied to the top of a container.
Figure 3:
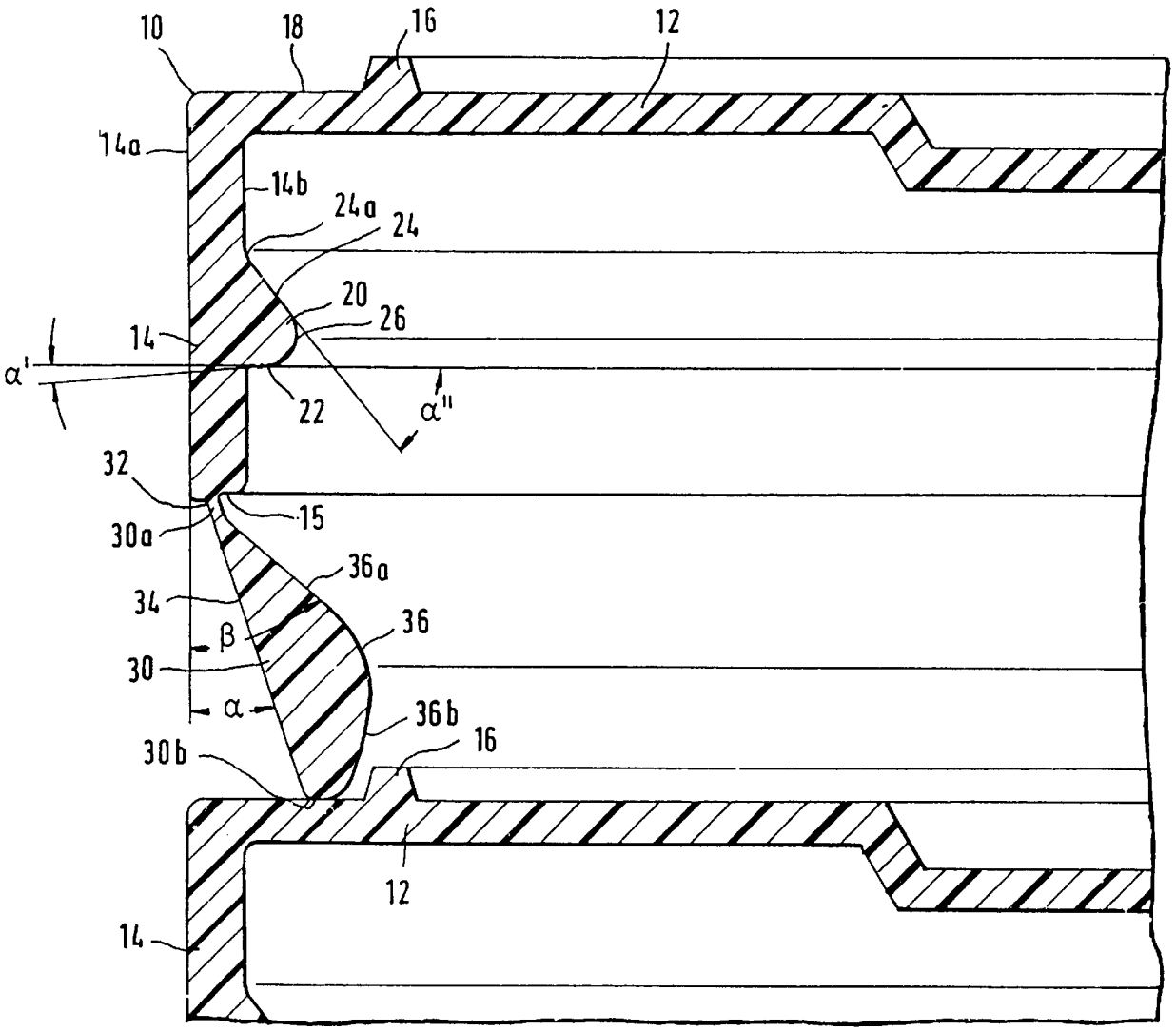
FIG. 3 is a partial cross-sectional view in enlarged scale of the cover or lid in accordance with the invention, in stacked position on a second cover or lid of the invention.

In FIG. 1 there is shown a pilferproof or tamper resistant cover 10 or lid of the invention mounted on top of a container, such as a metallic container (only the upper end portion thereof being shown). As best shown in FIG. 3, the cover 10 has a circular end wall 12. A cylindrical skirt 14 extends downwardly from the outer periphery of the end wall 12. An annular rib 16 extends upwardly from the upper surface 18 of the end wall 12. The annular rib 16 has a truncated cross-sectional shape and it is spaced radially inwardly from the outer cylindrical surface 14*a* of the cylindrical skirt 14 or from the outer peripheral edge of the end wall 12. The cylindrical skirt 14 has on its radially inner cylindrical surface 14*b* a radially inwardly projecting annular nose 20 disposed approximately centrally between the upper axial end and the lower axial end 15 of the cylindrical skirt 14. The nose 20 has a lower surface 22 and an upper surface 24 as well as rounded surface 26 interconnecting the lower surface 22 and the upper surface 24. The lower surface 22 is inclined downwardly toward the lower end 15 of the annular skirt 14 at an acute angle a' of approximately 5 degrees with respect to a radial line normal to the longitudinal axial centerline x—x (FIG. 1) of the cover. The upper surface 24 is inclined at a larger angle a" of approximately 45° with respect to a radial line normal to the longitudinal axis x—x of the cover. The upper surface is connected by a radiused surface portion 24*a* to the axial inner wall 14*b* of the cylindrical skirt 14.

An annular safety ring or guarantee strip 30 is connected at its upper end 30*a* by means of a thin tear-off connection 32 to the lower end 15 of the cylindrical skirt 14. The safety ring 30, as shown in FIG. 3 is generally teardrop-shaped or half teardrop-shaped in cross-section and generally inclined radially inwardly from its upper end 30*a* at the tear-off connection 32 to its lower end 30*b*. The lower end 30*b* of the safety ring 30 has a diameter larger than the outer diameter of the rib 16 but smaller than the outer diameter of the skirt 14 or the outer diameter of end wall 12. The safety ring 30 has a generally flat outer surface 34 extending from the upper end 30*a* to the lower end 30*b* of the safety ring 30. The flat outer surface 34 is tapered inwardly at an acute angle $\alpha$ of approximately 19° with respect to the outer surface of the skirt 14 or an axial line extending parallel to the longitudinal centerline x—x of the cover 10. The safety ring 30 has furthermore a convex, inwardly bulged inner surface 36 consisting of a generally flat inner upper surface section 36*a* and a curved inner lower surface section 36*b*. The maximum thickness T of the safety ring 30 is closer to its lower end 30*b* than to its upper end 30*a*. The flat upper surface section 36*a* extends from the upper end 30*a* of the safety ring 30 to approximate a mid point of the axial length of the safety ring 30. The lower surface section 36*b* extends from the lower end of the flat upper surface section 36*a* and forms the lower end 30*b* of the safety ring 30. As shown in FIG. 3*a*, the curved inner lower surface section 36*b* of the safety ring 30 has a first intermediate curved surface portion 36*b*' having a first radius of curvature R1, a second curved surface portion 36*b*" between the intermediate curved surface portion 36*b*' and the flat inner upper surface section 36*a* and having a second radius of curvature R2, and a third curved surface portion 36*b*'" between the intermediate curved surface portion 36*b*' and the flat outer surface 34 at the lower end 30*b* of the safety ring 30 and having a third radius of curvature R3, wherein the second radius of curvature R2 is smaller than the first radius of curvature R1 and the third radius of curvature R3 is smaller than the second radius of curvature R2. The flat upper surface section 36*a* is inclined inwardly from the upper end 30*a* of the safety ring 30 at an angle $\beta$ of approximately 48°. This facilitates conventional rolling on of the cover onto a container without the need for special tools for widening or enlarging the cover at the end of the safety ring.

A plurality of covers can be safety stacked on one another for packaging and shipment. In the stack the lower end 30*b* of the generally inwardly inclined safety ring 30 of each cover will engage the surface portion of the upper wall 18 of the end wall 12 of an adjacent underlying cover radially outwardly of the annular rib 16 between the rib 16 and the outer periphery of the end wall 12. The annular rib 16 resists undesired relative movement of the covers in the stack in a direction transverse to the longitudinal centerline of the covers to the extent that the covers cannot slip-off from one another in transverse direction whereby the covers can be safely stacked on one another to provide a stable stack facilitating packaging and shipment. In FIG. 1 an adjacent underlying cover is schematically indicated in phantom lines.

Figure 2:
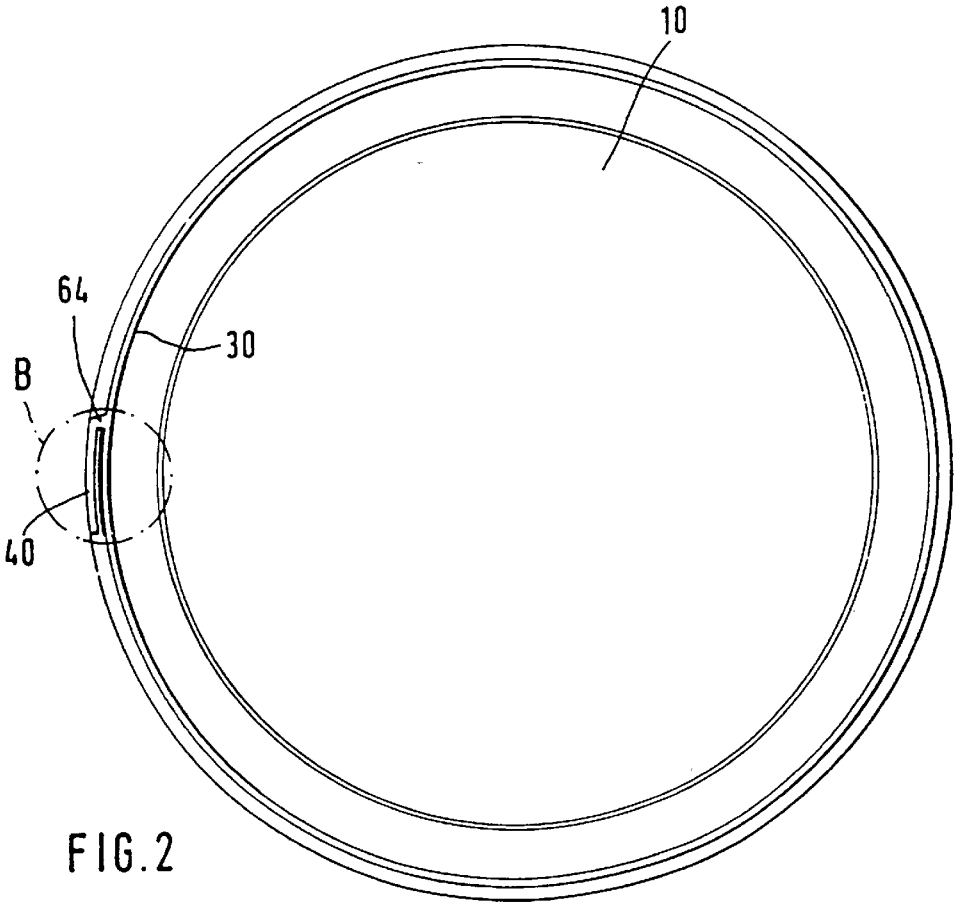
FIG. 2 is a bottom view of the cover or lid of FIG. 1, showing the safety band or ring with its tear-off lip portion.

As can be seen from the bottom view of FIG. 2, the cover has a tab 40 which is connected by narrow rupturable connections 42*a*, 42*b*, 42*c* as shown in the enlarged detail of FIG. 4, the perspective view of FIG. 5 and also in FIG. 6, to the safety ring 30 and the skirt 14. The tab 40 is adapted to be grasped by the user's fingers for tearing off the safety ring 30 from the lower end of the cylindrical or circumferential skirt 14 along the connection 32. The tab 40 is generally parallel to the skirt 14 and is accordingly disposed at an angle with respect to the radially inwardly inclined safety ring 30. This facilitates grasping of the tab for tearing off the safety ring 30 from the skirt 14 of the cover 10. Preferably, the tab 40 does extend radially beyond the skirt 14 in order to prevent interference of the covers 10 with one another or with the cover manipulating machines during fabrication and stacking of the covers 10 and also during application of the covers 10 to the containers.

In FIG. 1 and as best shown in FIG. 4 a pilferproof or tamper resistant cover 10 is shown engaged on a container C, such as a metallic container. It can be seen that the container C has at its upper end a circumferential flange 50 projecting from the outer circumferential wall 52 of the container C. When the cover 10 is placed on the container C the flange 50 is received within the circumferential skirt 14 between the end wall 12 of the cover 10 and the radially inwardly projecting nose 26. The lower portion of the circumferential flange 50 has a decreasing diameter and is contoured to correspond substantially to the inwardly inclined shape of the upper surface 24 of the nose 20.

Spaced below the circumferential flange 50 the container C has in its outer wall 52 a circumferential radially outwardly opening groove 54 which is adapted to partly receive the safety ring 30 therein. The groove 54 has a rounded bottom portion 56 and two diverging side portions 58 interconnecting the rounded bottom portion 56 with the outer surface of the outer circumferential wall 52 of the container. The inclination of the diverging upper side wall portion 58 of the groove 54 corresponds generally to the inclination of the flat upper inner surface section 36*a* of the safety ring 30. The lower portion of the safety ring 30 extends into the groove 54 and the lowermost end of the safety ring 30 is at least closely adjacent or contacts the lower inclined side surface 58 of the groove 54. The diameter of the safety ring 30 at the lower end 30*b* thereof, namely the diameter of the safety ring 30 at the lower end of the flat outer surface 34 is generally identical to the diameter of the outer surface of the outer circumferential wall 52 of the container C. Accordingly, the lower end portion of the safety ring 30 is tightly nested within the groove 54 thereby providing a generally smooth transition between the lower end of the inwardly inclined safety ring 30 and the outer surface of the container outer wall 52 making it impossible to remove the cover 10 from the container without previously tearing off the safety ring 30.

As an alternative to the described embodiment the radially inwardly projecting nose 20 at the inner wall of the skirt 14 may also be formed closely adjacent to the lower end 15 of the circumferential skirt 14.

The cover is preferably formed of plastic material.

As shown in FIG. 5, at the tear-off tab 40 the safety band 30 is weakened and does not extend upwardly the full height of the safety band up to the lower end 15 of the circumferential skirt 14. Radially inwardly of the tab 40 the safety band 30 has a cut-out portion 60 extending over a circumferential length generally corresponding to the circumferential length of the tear-off tab 40. The cut-out portion 60 is bounded at its lower end by a remaining web portion 62 of the safety ring 30 and is bounded at its upper end by the lower end 15 of the skirt 14. The tear-off tab 40 has on its outer surface the narrow rupturable connections 42*a* to connect the tab 40 to the skirt 14 and has on its inner surface narrow rupturable connections 42*b* connecting the tab 40 to the remaining web portion 62 of the safety ring 30. A radial triangular wall portion 64 connects the tab 40 at its rear end to the safety ring 30. In FIG. 5 the tear-off tab 40 is shown in an outwardly opened position with the narrow connections 42*a* between the tear-off tab 40 and the skirt 14 as well as the narrow connections 42*b* between lower remaining web portion 62 of the safety ring 30 ruptured prior to fully tearing off the safety ring 30 from the remaining portion of the cover 10. The remaining web portion 62 is connected by a rupturable tab 42*c* to the safety ring 30 as also shown in FIG. 5.

While a preferred embodiment of the invention has been illustrated and described, it should be understood that variations and modifications thereof will be apparent to one skilled in the art without departing from the principles hereindescribed.

What we claim is:

1. A pilferproof cover having an axial centerline, for a container, comprising:

a circular end wall having an upper end surface and an outer periphery having a diameter;

a cylindrical skirt extending downwardly from the outer periphery of the end wall and having a lower end and a radially inner surface and an outer axial surface;

means for removably retaining the cover on a container, said means being provided on the radially inner surface of the skirt;

an annular tear-off safety ring extending downwardly and radially inwardly from the lower end of the skirt, said safety ring having an upper end and a lower end, the upper end of the safety ring being connected by means of a circumferentially extending rupturable connection to the lower end of the skirt, the safety ring having a generally convex inwardly bulged inner surface;

wherein the safety ring has a generally flat outer surface tapering inwardly relative to the outer surface of the skirt;

wherein the flat outer surface forms a first acute angle with a line extending parallel to the axial centerline of the cover, said flat outer surface extending substantially from the upper end of the safety ring to the lower end thereof, and said inner surface has an upper generally flat surface section extending from the upper end of the safety ring and a lower curved surface section extending from the flat surface section to the lower end of the safety ring, said upper flat surface section forming, with said parallel line, a second acute angle which is larger than the first acute angle; and wherein the curved inner lower surface section of the safety ring has a first intermediate curved surface portion having a first radius of curvature, a second curved surface portion between the intermediate curved surface portion and the flat inner upper surface section and having a second radius of curvature, and a third curved surface portion between the intermediate curved surface portion and the flat outer surface at the lower end of the safety ring and having a third radius of curvature, wherein the second radius of curvature is smaller than the first radius of curvature and the third radius of curvature is smaller than the second radius of curvature.

2. A cover according to claim 1, wherein the safety ring has a maximum thickness closer to its lower end than to its upper end.

3. A cover according to claim 2, wherein the safety ring is generally half tear-shaped in cross section.

4. A cover according to claim 1, wherein the safety ring has a tear-off tab which does not extend radially outwardly beyond the outer axial surface of the skirt.

5. A cover according to claim 1, wherein an annular rib having an outer diameter is provided on the upper end surface of the end wall and spaced radially inwardly from the outer periphery thereof and the lower end of the safety ring has a diameter larger than the outer diameter of the annular rib and smaller than the diameter of the outer periphery of the circular end wall so that the cover can be stacked on another like cover with the annular safety ring of the first cover engaging said other cover on the end wall between the outer periphery thereof and the annular rib so that the annular rib prevents slipping off of the covers from one another in transverse direction.

6. In combination, a container and a pilferproof cover mounted on one end of the container having a cylindrical outer wall, wherein the container has at said one end a circumferential projection extend radially beyond the outer wall of the container and a circumferential groove in the outer wall of the container spaced below the circumferential projection, and the pilferproof cover has:

an axial centerline and a circular end wall having an upper end surface and an outer periphery having a diameter, a cylindrical skirt disposed about said container extending downwardly from the outer periphery of the end wall and having a lower end and a radially inner surface and an outer axial surface;

means engaging said circumferential projection of said container for removably retaining the cover on said container, said means being provided on the radially inner surface of the skirt;

an annular safety ring extending downwardly and radially inwardly from the lower end of the skirt, said safety ring being connected by means of a circumferentially extending rupturable connection to the lower end of the skirt, the safety ring having a generally convex inwardly bulged inner surface;

wherein the safety ring has a generally flat outer surface tapering inwardly relative to the outer surface of the skirt, wherein the flat outer surface forms a first acute angle with a line extending parallel to the axial centerline of the cover, said flat outer surface extending substantially from the upper end of the safety ring to the lower end thereof, and said inner surface has an upper generally flat surface section extending from the upper end of the safety ring and a lower curved surface section extending from the flat surface section to the lower end of the safety ring, said upper flat surface section forming, with said parallel line, a second acute angle which is larger than the first acute angle, wherein the curved inner lower surface section of the safety ring has a first intermediate curved surface portion having a first radius of curvature, a second curved surface portion between the intermediate curved surface portion and the flat inner upper surface section and having a second radius of curvature, and a third curved surface portion between the intermediate curved surface portion and the flat outer surface at the lower end of the safety ring and having a third radius of curvature, wherein the second radius of curvature is smaller than the first radius of curvature and the third radius of curvature is smaller than the second radius of curvature, and wherein with the cover mounted on the container a lower end portion of the safety ring is snugly nested within the circumferential groove with the diameter of the lower end of the safety ring being substantially equal to the outer diameter of the container and the lower end of the safety ring being closely adjacent to or contacting the outer container wall substantially at a location where a lower edge of the circumferential groove merges with the cylindrical outer wall of the container.

7. The combination of claim 6, wherein the safety ring has a maximum thickness closer to its lower end than to its upper end.

8. The combination of claim 7, wherein the safety ring is generally half tear-shaped in cross-section.

9. The combination of claim 6, wherein the safety ring has a tear-off tab which does not extend radially outwardly beyond the outer axial surface of the skirt.

10. The combination of claim 6, wherein an annular rib having an outer diameter is provided on the upper end surface of the end wall and spaced radially inwardly from the outer periphery thereof and the lower end of the safety ring has a diameter larger than the outer diameter of the annular rib and smaller than the diameter of the outer periphery of the circular end wall so that the cover can be stacked on another like cover with the annular safety ring of the first cover engaging said other cover on the end wall between the outer periphery thereof and the annular rib so that the annular rib prevents slipping off of the covers from one another in transverse direction.

11. In combination, a container and a pilferproof cover mounted on one end of the container having a cylindrical outer wall, wherein the container has at said one end a circumferential projection extend radially beyond the outer wall of the container and a circumferential groove in the outer wall of the container spaced below the circumferential projection, and the pilferproof cover has:

an axial centerline and a circular end wall having an upper end surface and an outer periphery having a diameter;

a cylindrical skirt disposed about said container extending downwardly from the outer periphery of the end wall and having a lower end and a radially inner surface and an outer axial surface;

means engaging said circumferential projection of said container for removably retaining the cover on said container, said means being provided on the radially inner surface of the skirt;

an annular safety ring extending downwardly and radially inwardly from the lower end of the skirt, said safety ring being connected by means of a circumferentially extending rupturable connection to the lower end of the skirt, the safety ring having a generally convex inwardly bulged inner surface;

wherein with the cover mounted on the container a lower end portion of the safety ring is snugly nested within the circumferential groove with the diameter of the lower end of the safety ring being substantially equal to the outer diameter of the container and the lower end of the safety ring being closely adjacent to or contacting the outer container wall substantially at a location where a lower edge of the circumferential groove merges with the cylindrical outer wall of the container; and wherein the groove is V-shaped and has a rounded bottom and two inclined side walls smoothly merging with the cylindrical outer wall of the container.

12. A pilferproof cover having an axial centerline, for a container, comprising:

a circular end wall having an upper end surface and an outer periphery having a diameter;

a cylindrical skirt extending downwardly from the outer periphery of the end wall and having a lower end and a radially inner surface and an outer axial surface;

means for removably retaining the cover on a container, said means being provided on the radially inner surface of the skirt;

an annular tear-off safety ring extending downwardly and radially inwardly from the lower end of the skirt, said safety ring having an upper end and a lower end, the upper end of the safety ring being connected by means of a circumferentially extending rupturable connection to the lower end of the skirt, the safety ring having a generally convex inwardly bulged inner surface;

wherein said lower curved portion has a compound radius of curvature to facilitate slipping on of the cover onto an end of the container; and wherein the curved inner surface portion of the safety ring has a first intermediate curved surface having a first radius of curvature, a second curved surface between the intermediate curved surface and the upper flat inner surface portion and having a second radius of curvature, and a third curved surface between the intermediate curved surface and the lower end of the safety ring and having a third radius of curvature, wherein the second radius of curvature is smaller than the first radius of curvature and the third radius of curvature is smaller than the second radius of curvature.

13. In combination, a container and a pilferproof cover mounted on one end of the container having a cylindrical outer wall, wherein the container has at said one end a circumferential projection extend radially beyond the outer wall of the container and a circumferential groove in the outer wall of the container spaced below the circumferential projection, and the pilferproof cover has:

an axial centerline and a circular end wall having an upper end surface and an outer periphery having a diameter;

a cylindrical skirt disposed about said container extending downwardly from the outer periphery of the end wall and having a lower end and a radially inner surface and an outer axial surface;

means engaging said circumferential projection of said container for removably retaining the cover on said container, said means being provided on the radially inner surface of the skirt;

an annular safety ring extending downwardly and radially inwardly from the lower end of the skirt, said safety ring being connected by means of a circumferentially extending rupturable connection to the lower end of the skirt, the safety ring having a generally convex inwardly bulged inner surface;

wherein with the cover mounted on the container a lower end portion of the safety ring is snugly nested within the circumferential groove with the diameter of the lower end of the safety ring being substantially equal to the outer diameter of the container and the lower end of the safety ring being closely adjacent to or contacting the outer container wall substantially at a location where a lower edge of the circumferential groove merges with the cylindrical outer wall of the container;

wherein said lower curved portion has a compound radius of curvature to facilitate slipping on of the cover onto an end of the container; and wherein the curved inner surface portion of the safety ring has a first intermediate curved surface having a first radius of curvature, a second curved surface between the intermediate curved surface and the upper flat inner surface portion and having a second radius of curvature, and a third curved surface between the intermediate curved surface and the lower end of the safety ring and having a third radius of curvature, wherein the second radius of curvature is smaller than the first radius of curvature and the third radius of curvature is smaller than the second radius of curvature.

* * * * *